US008142175B2

(12) United States Patent
Duppert et al.

(10) Patent No.: US 8,142,175 B2
(45) Date of Patent: Mar. 27, 2012

(54) MOUNTING BASE AND SCROLL COMPRESSOR INCORPORATING SAME

(75) Inventors: Ronald J. Duppert, Fayetteville, NY (US); Kenneth D. Heusler, Palmyra, NY (US)

(73) Assignee: Bitzer Scroll Inc., East Syracuse, NY (US)

( * ) Notice: Subject to any disclaimer, the term of this patent is extended or adjusted under 35 U.S.C. 154(b) by 702 days.

(21) Appl. No.: 12/015,643

(22) Filed: Jan. 17, 2008

(65) Prior Publication Data

US 2009/0185929 A1 Jul. 23, 2009

(51) Int. Cl.

| | |
|---|---|
| ***F01C 1/063*** | (2006.01) |
| ***F04C 2/063*** | (2006.01) |
| ***F16M 1/04*** | (2006.01) |
| ***F16M 9/00*** | (2006.01) |
| ***F16M 5/00*** | (2006.01) |

(52) U.S. Cl. .. 418/55.1; 417/360; 417/363; 248/346.01; 248/678

(58) Field of Classification Search ..... 418/55.1, 418/55.2, 55.3, 55.6, 86; 417/360, 363; 248/346.01, 248/678

See application file for complete search history.

(56) References Cited

U.S. PATENT DOCUMENTS

| | | | | |
|---|---|---|---|---|
| 2,910,262 | A | 10/1959 | Haessler | |
| 3,310,268 | A | 3/1967 | Kramer | |
| 4,019,704 | A | 4/1977 | Levine | |
| 4,076,197 | A | 2/1978 | Dochterman | |
| 4,441,684 | A | 4/1984 | Credle, Jr. | |
| 4,655,696 | A | 4/1987 | Utter | |
| 4,696,630 | A | 9/1987 | Sakata et al. | |
| 4,927,339 | A | 5/1990 | Riffe et al. | |
| 5,090,878 | A | 2/1992 | Haller | |
| 5,277,554 | A * | 1/1994 | Elson | 417/363 |
| 5,320,506 | A | 6/1994 | Fogt | |
| 5,332,188 | A | 7/1994 | Davis et al. | |
| 5,427,511 | A | 6/1995 | Caillat et al. | |
| 5,582,312 | A | 12/1996 | Niles et al. | |
| 6,227,830 | B1 | 5/2001 | Fields et al. | |
| 6,398,530 | B1 | 6/2002 | Hasemann | |
| 6,439,867 | B1 | 8/2002 | Clendenin | |
| 6,488,489 | B2 | 12/2002 | Williams et al. | |
| 6,648,616 | B2 * | 11/2003 | Patel et al. | 417/572 |
| 6,682,327 | B2 | 1/2004 | Milliff et al. | |

(Continued)

FOREIGN PATENT DOCUMENTS

EP 0 697 758 A2 2/1996

(Continued)

OTHER PUBLICATIONS

ASM Handbook vol. 14B Metalworking: Sheet Forming, Editor: Semiatin, Sep. 2006, ASM International, pp. 11-19.*

(Continued)

*Primary Examiner* — Mary A Davis
(74) *Attorney, Agent, or Firm* — Reinhart Boerner Van Deuren P.C.

(57) ABSTRACT

A scroll compressor assembly includes a mounting base with a pair of support ribs formed into the mounting base, for structurally strengthening the support provided by the mounting base. The mounting base may either support the scroll compressor housing as a separate component part or may integrally form part of the scroll compressor housing. The mounting base has at least two tracks for rail mounting of the scroll compressor assembly and typically includes holes for fasteners and/or grommets.

20 Claims, 7 Drawing Sheets

U.S. PATENT DOCUMENTS

| | | | | |
|---|---|---|---|---|
| 6,695,201 | B2 * | 2/2004 | Narasipura et al. | 418/55.1 |
| 6,761,541 | B1 | 7/2004 | Clendenin | |
| 6,814,551 | B2 | 11/2004 | Kammhoff et al. | |
| 6,948,916 | B2 * | 9/2005 | Hebert | 417/360 |
| 6,960,070 | B2 | 11/2005 | Kammhoff et al. | |
| 7,112,046 | B2 | 9/2006 | Kammhoff et al. | |
| 2003/0072662 | A1 | 4/2003 | Reinhart | |
| 2005/0053486 | A1 | 3/2005 | Gilliam et al. | |
| 2008/0219865 | A1 * | 9/2008 | Hodapp et al. | 417/363 |
| 2009/0185921 | A1 | 7/2009 | Beagle et al. | |
| 2009/0185926 | A1 | 7/2009 | Bush | |
| 2009/0185927 | A1 | 7/2009 | Duppert et al. | |
| 2009/0185928 | A1 | 7/2009 | Bush et al. | |
| 2009/0185930 | A1 | 7/2009 | Duppert et al. | |
| 2009/0185931 | A1 | 7/2009 | Beagle et al. | |
| 2009/0185932 | A1 | 7/2009 | Beagle et al. | |
| 2009/0185933 | A1 | 7/2009 | Bush et al. | |
| 2009/0185934 | A1 | 7/2009 | Bush | |

FOREIGN PATENT DOCUMENTS

| | | | |
|---|---|---|---|
| EP | 0 909 006 | A2 | 4/1999 |

OTHER PUBLICATIONS

ASM Handbook vol. 14A Metalworking: Bulk Forming, Editor: Semiatin, Oct. 2005, ASM International, pp. 741-758.*

James G. Bralla, Handbook of Manufacturing Processes How Products, Components and Materials are Made, 2007, Industrial Press, pp. 56-57.*

* cited by examiner

MOUNTING BASE AND SCROLL COMPRESSOR INCORPORATING SAME

FIELD OF THE INVENTION

The present invention relates to scroll compressors for compressing refrigerant and more particularly to the mounting bases of such scroll compressors, which may be used to mount the scroll compressor on a set of rails.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purposes of compressing refrigerant. An appropriate drive unit, typically an electric motor, is provided usually within the same housing to drive the movable scroll member.

Scroll compressor assemblies typically include a mounting base, which supports the scroll compressor. An example of a mounting base in the form of a mounting plate is shown in U.S. Pat. No. 6,761,541 to Clendenin. As shown therein, the mounting plate includes a central aperture which supports a scroll compressor and upwardly and downwardly depending flanges around the parameter that provide for support and mounting to a pair of rails. The present invention is directed toward improvements over the existing mounting base designs, such as shown in the '541 patent.

BRIEF SUMMARY OF THE INVENTION

In one aspect, the invention provides a scroll compressor assembly having a support rib formed into the mounting base. The mounting base may either support the scroll compressor housing as a separate component part or may integrally form part of the scroll compressor housing. A scroll compressor assembly in accordance therewith includes a scroll compressor and a mounting base for supporting the scroll compressor. The mounting base has at least two tracks, an outer peripheral edge and at least one support rib. The at least one support rib is formed into the mounting base and projects in spaced relation to the outer peripheral edge.

In another aspect, the invention provides a mounting plate for a scroll compressor, which can provide for a mounting base. The mounting plate comprises a unitary formed metal component part having a body portion with four sides. A central region of the mounting plate forms a nest for support of the scroll compressor. A pair of tracks in the form of flanges depend downwardly from the opposing sides of the body portion. A pair of support ribs formed into the body portion extend transversely between the flanges. The support ribs can have a generally U-shaped cross section.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
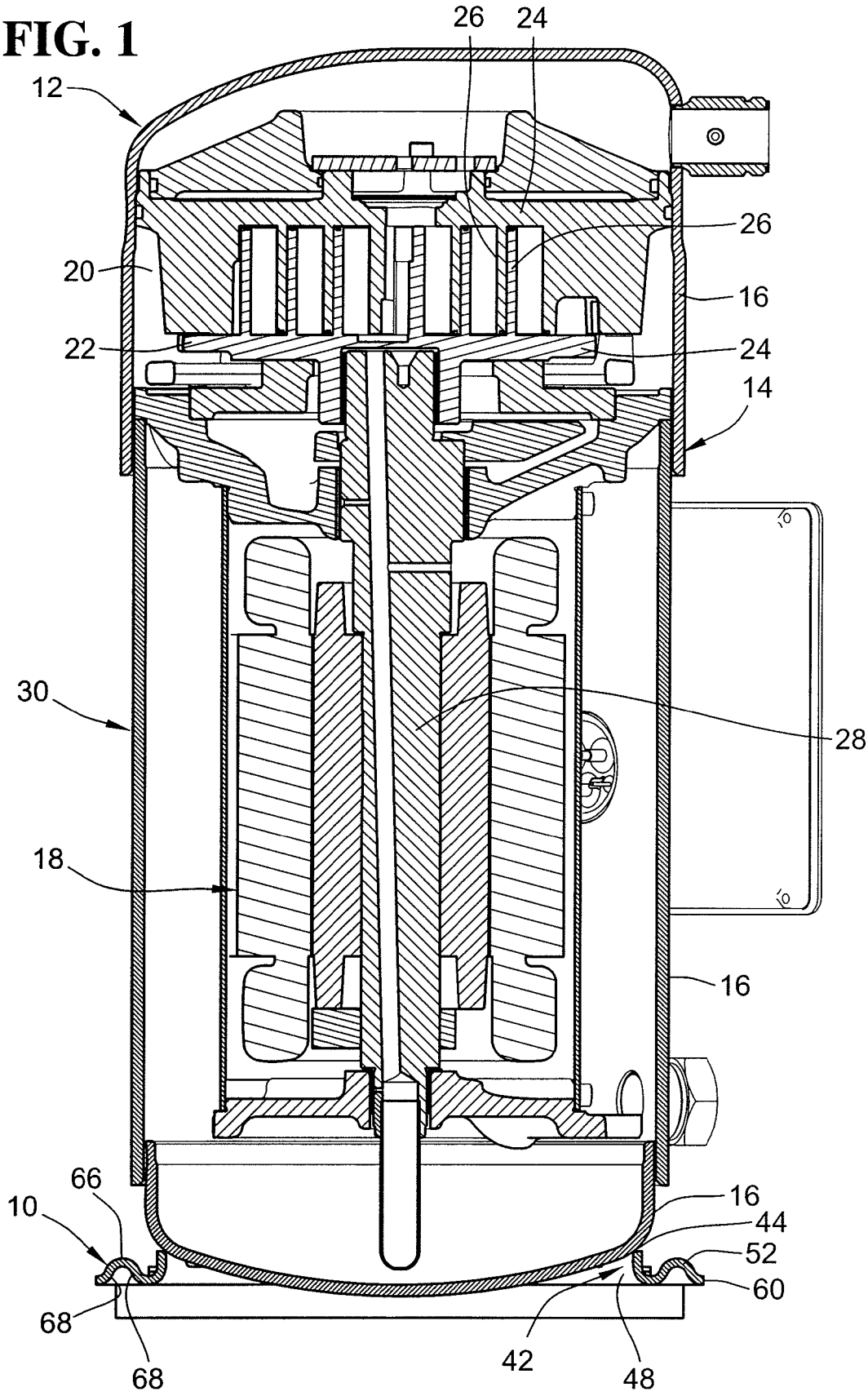
FIG. 1 is a cross section of a scroll compressor assembly in accordance with an embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention has been illustrated as a mounting base 10 and a scroll compressor assembly 12 incorporating the same as shown in FIGS. 1-7.

Before turning to the details of the mounting base 10, some background about the illustrated scroll compressor assembly 12 will be provided for orientation purposes, although it is understood that this invention is applicable to other compressor configurations. The scroll compressor assembly 12 generally includes an outer housing 14 that typically comprises one or more stamp-formed sheet steel shell sections 16 that are welded together. Contained within the housing 14 is a drive unit 18 that may take the form of an electrical motor and a pair of scroll compressor bodies to include a fixed scroll compressor body 20 and a movable scroll compressor body 22. The scroll compressor bodies 20, 22 have respective bases 24 and respective scroll ribs 26 that project from the respective bases 24 and which mutually engage for compression fluid. The drive unit 18 has a rotational output on a drive shaft 28 that is operable to drive the movable scroll compressor body 22 about an orbital path relative to the fixed scroll compressor body 20 and thereby facilitates the compression of fluid. Further details of such a scroll compressor arrangement is further described in the aforementioned patents which have been hereby incorporated by reference in their entireties. Collectively, the housing 14 and the components therein (e.g. the drive units 18, and scroll compressor bodies 20, 22) may be referred to as making up a scroll compressor 30.

Figure 2:
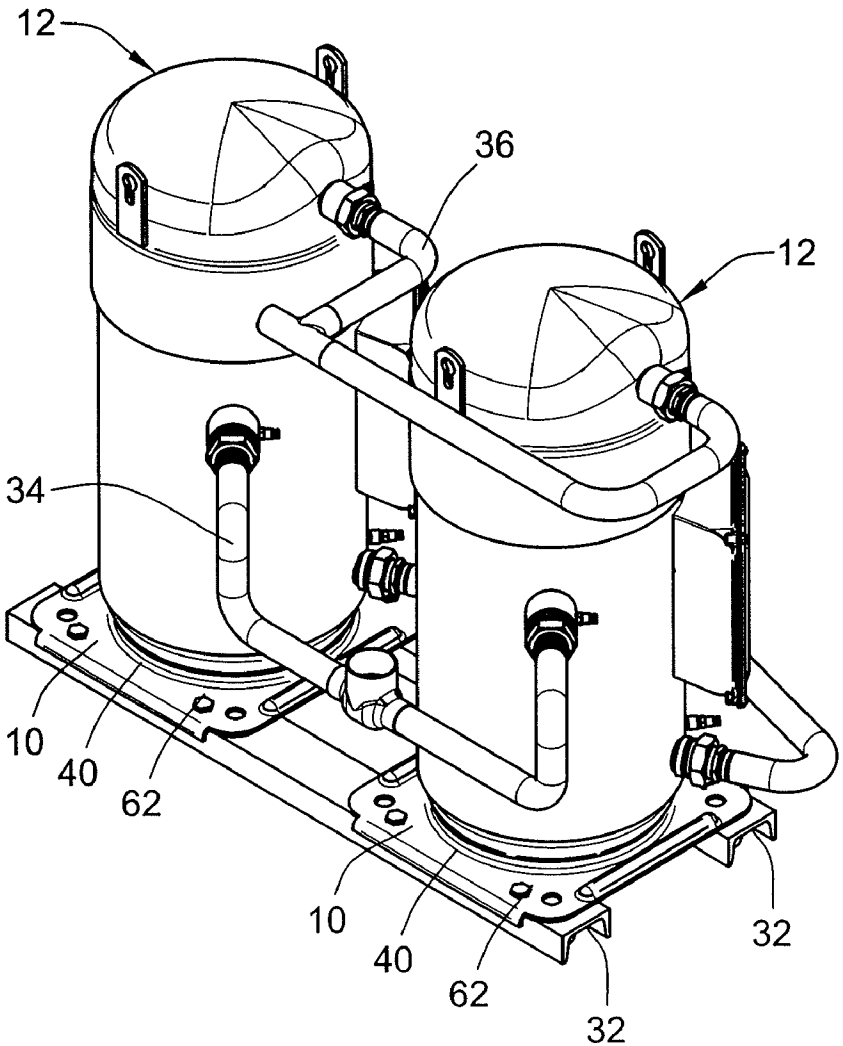
FIG. 2 is an isometric view of multiple scroll compressor assemblies that are mounted to a pair of rails in accordance with an embodiment of the present invention.
Figure 3:
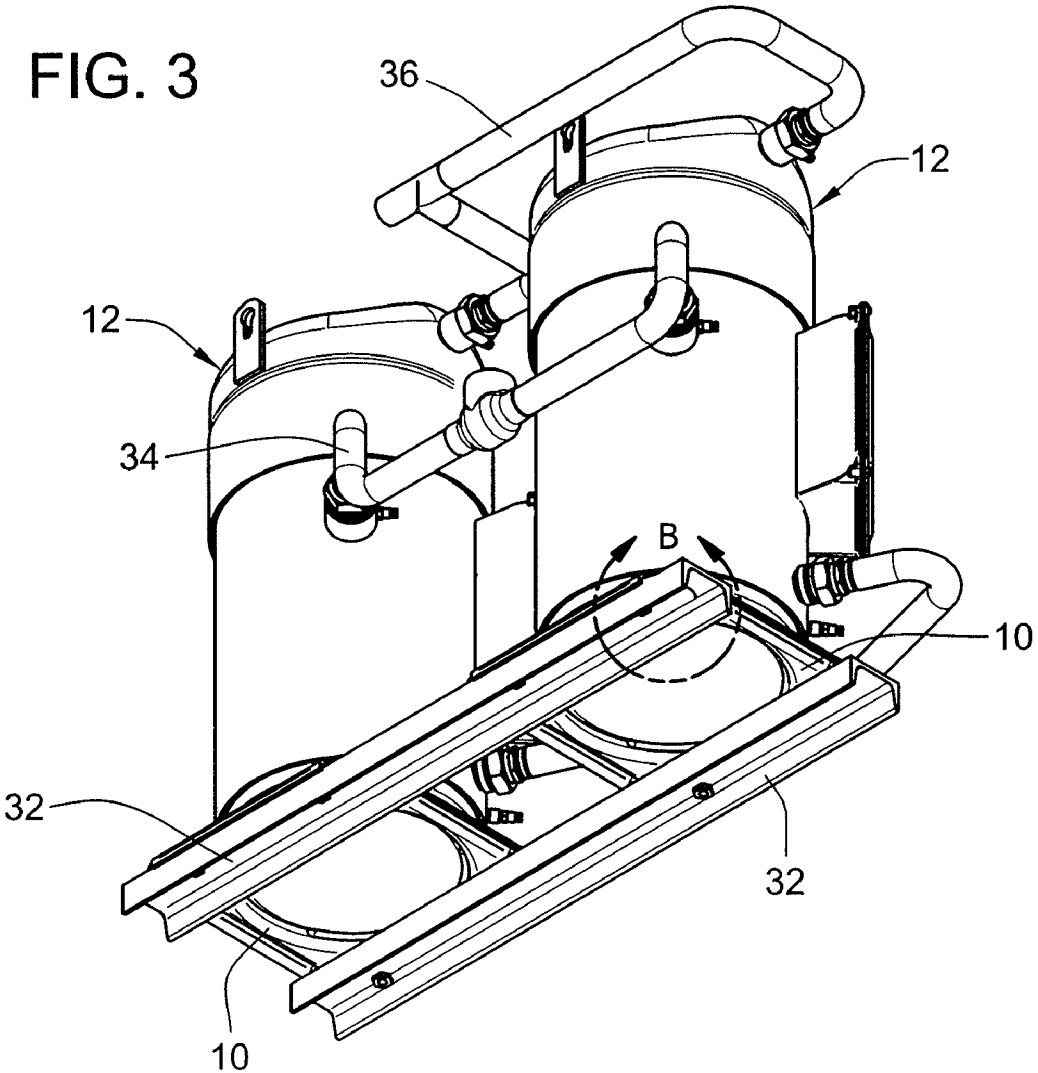
FIG. 3 is an isometric view of the apparatus of FIG. 2 but taken about a different bottom side view.
Figure 5:
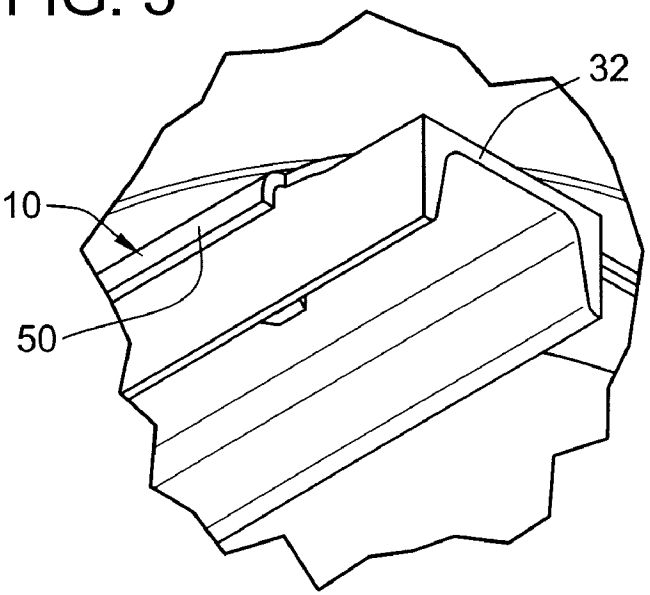
FIGS. 4 and 5 are close up isometric views of a portion of FIGS. 2 and 3 to better illustrate one of the fastening mechanisms shown in FIGS. 2 and 3.
Figure 4:
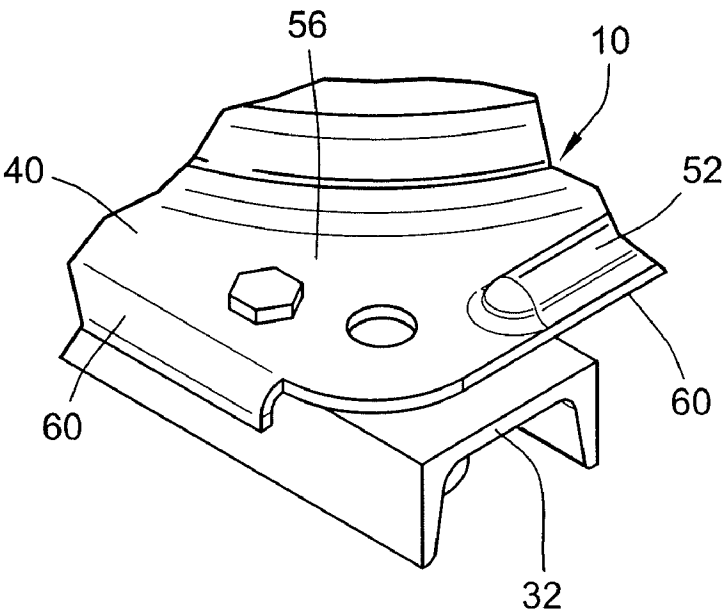
Figure 6:
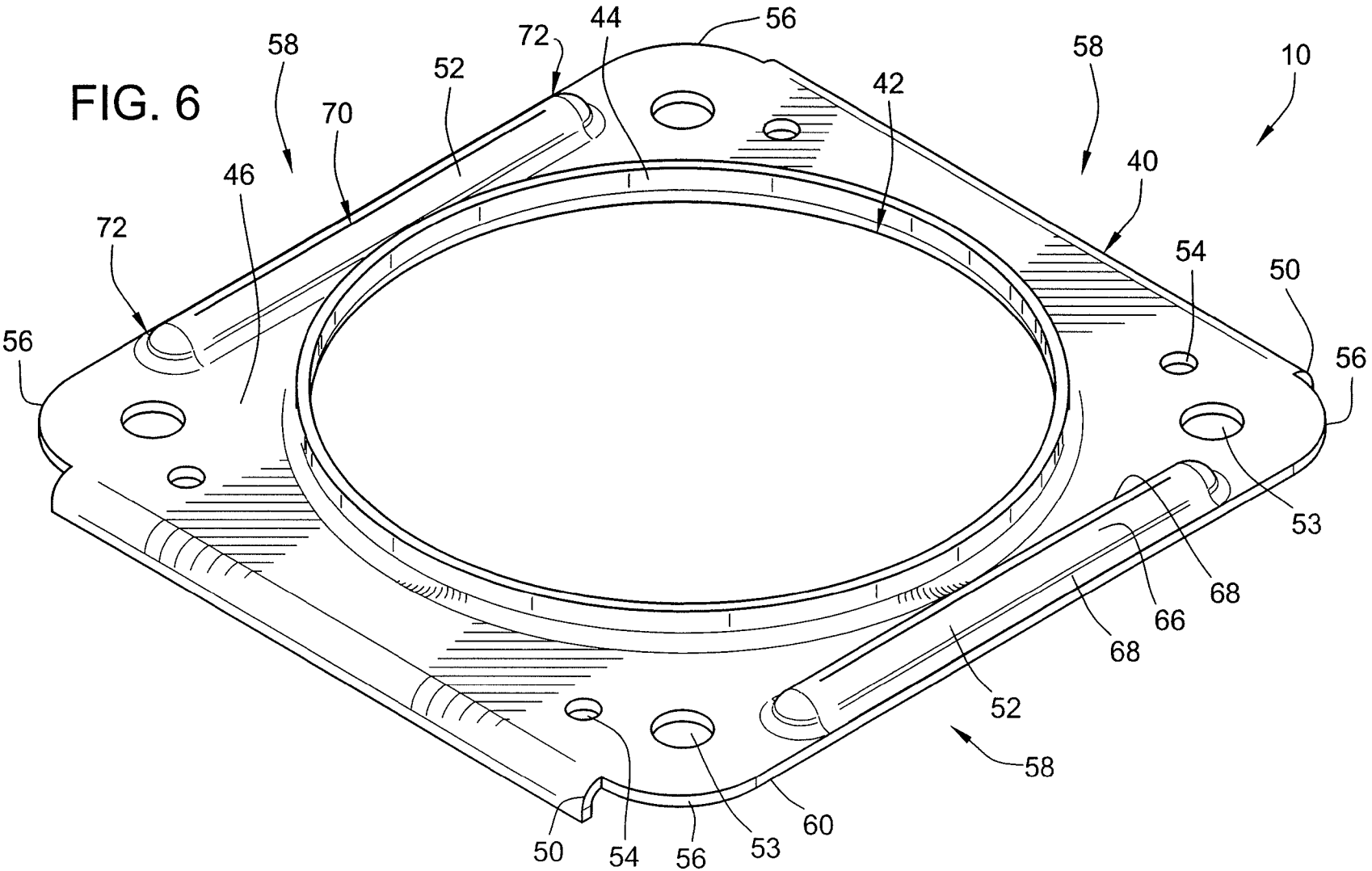
FIGS. 6 and 7 are isometric views of the mounting base alone for use with the scroll compressor assemblies of the prior embodiments with FIG. 6 showing the top side and FIG. 7 showing the bottom side.
Figure 7:
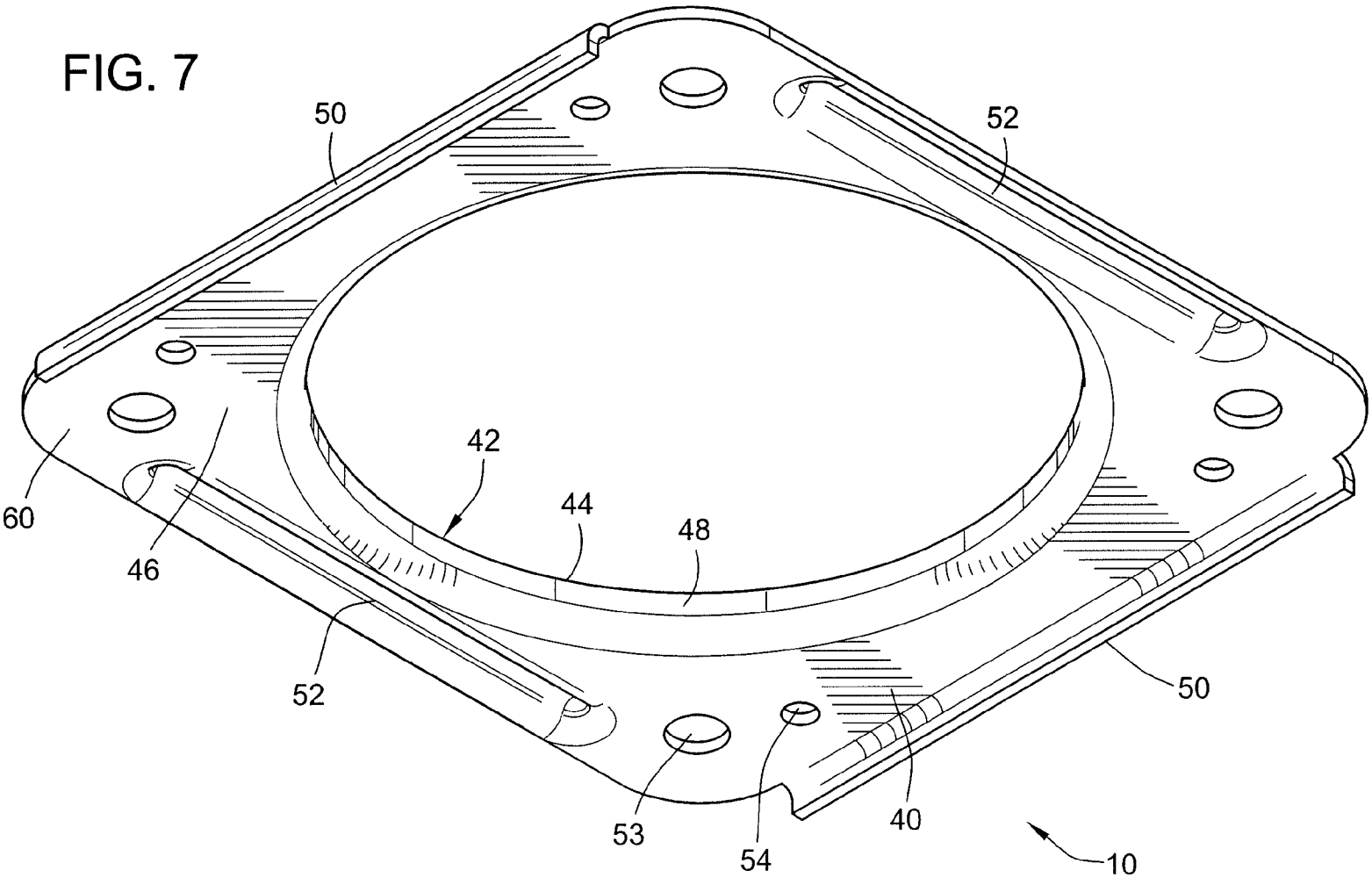

The mounting base 10 supports the weight of the scroll compressor 30 and provides for mounting of the overall scroll compressor assembly 12 to mounting structure shown as a pair of rails 32. As shown in FIGS. 2 and 3, multiple scroll compressor assemblies 12 can be rail mounted along a common set of the rails 32 and coupled together with conduits connecting respective inlet ports and out ports. Specifically, it is seen in FIGS. 2 and 3 that there is a common suction or refrigerant inlet conduit 34 for returning low pressure refrigerant from a refrigeration circuit and a common high pressure compressed refrigerant outlet conduit 36 that feeds high pressure compressed refrigerant back to a refrigerant circuit. As shown, these conduits 34, 36 fluidically connect the scroll compressor assemblies 12 together for connection to a refrigeration circuit. Each of the scroll compressor assemblies 12 are each also commonly mounted on the same rails 32 in a linear array.

Figure 8:
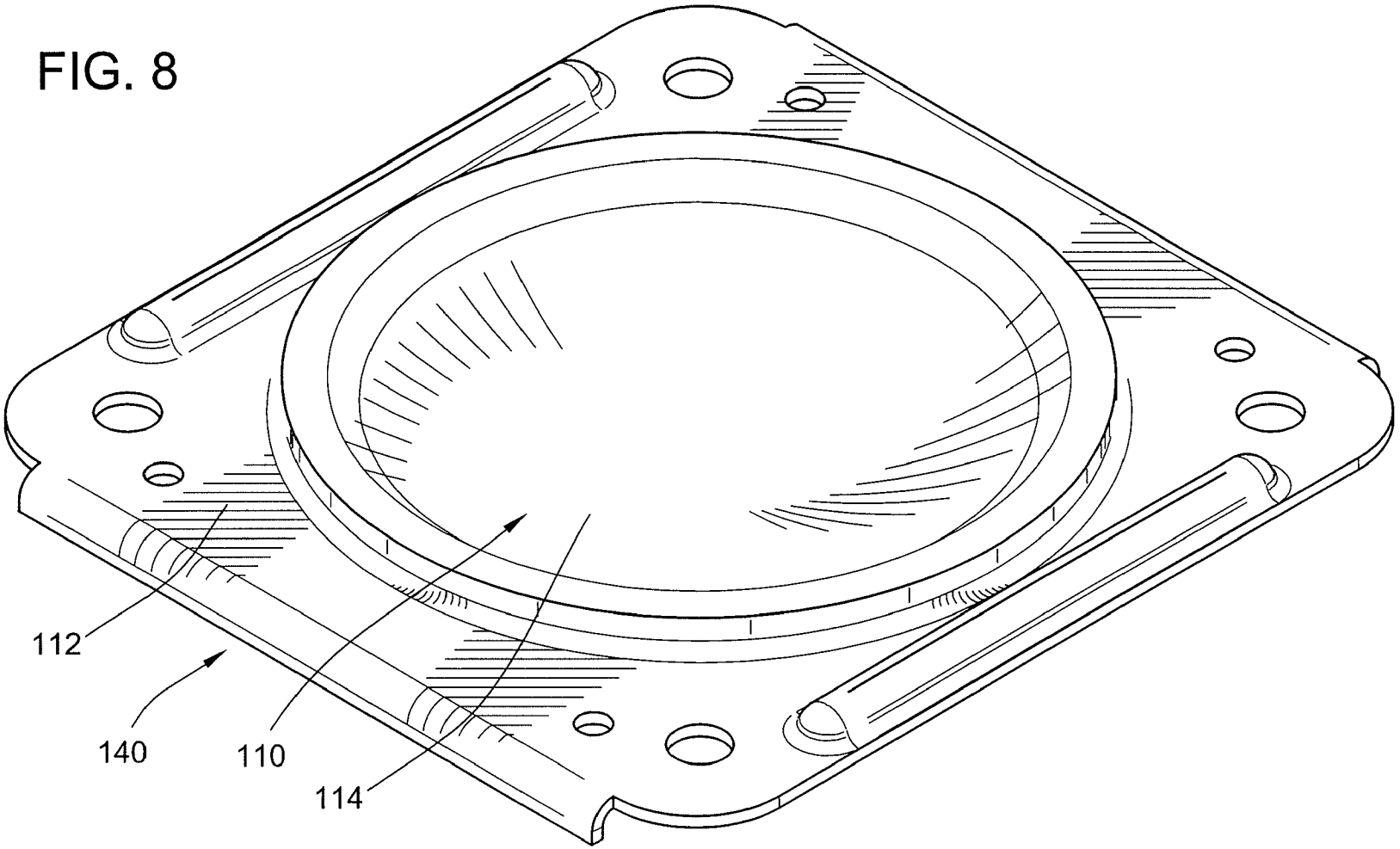
FIG. 8 is a perspective illustration of an alternative embodiment of a mounting base for supporting the scroll compressor in accordance with the present invention.

The mounting base 10 serves the functions of supporting the scroll compressor 30 and mounting the scroll compressor 30 to the rails 32. To provide for these functions, the disclosed embodiment of the mounting base can take the form of a stamped sheet metal mounting plate 40. This mounting plate 40 can be stamp-formed and cut out from sheet steel. To support the scroll compressor 30, the mounting plate can provide a central aperture 44 to provide for a nest 42 in which the lower shell section 16 of the housing 14 can be received and nested. Alternatively, as shown in FIG. 8, this region may be free of an aperture and solid and thereby form the lower most portion of the housing 14 integrally and as a unitary component. In either embodiment, the mounting base supports the scroll compressor.

As shown in the illustrated embodiment in the figures, the mounting plate can include a number of structural features to include a planar body region 46 into which the aperture 44 is formed; an upwardly depending circular ring wall 48 depending upwardly from the body region 46; a pair of mounting tracks that may take the form of flanges 50 depending downwardly from the body region 46 on opposed sides thereof, a pair of support ribs 52 formed into the body region 46 and extending transversely relative to the flanges; and mounting holes 53, 54 formed through the body region 46 for facilitating fastening of the scroll compressor assembly 12 to the rails 32.

At the nest 42 region of the mounting plate 40, the upwardly bent flange forms a circular ring wall 48 in which the lower most shell section 16 of the compressor housing 14 seats along a circular interface. Typically, the two components are permanently connected by such means as welding (either spot or circumferentially) and/or brazing. The circular wall 48 depends upwardly from the planar body region 46 of the mounting plate 40. As shown, the mounting plate 40 and body thereof has a generally rectangular configuration to include four arcuate corners 56 and four sides 58. An outer peripheral edge 60 runs around the rectangular perimeter of the mounting plate 40 and thereby generally defines its outer boundary. In each of the corner regions, at least one and sometimes two mounting holes 53, 54 are provided which can receive a fastener 62 as shown to facilitate fastening and thereby securement of the scroll compressor assembly 12 to the pair of rails 32. This is illustrated with additional detailing in FIGS. 2-5.

The mounting plate 40 includes tracks for mounting upon the pair of parallel rails 32, which take the form of mounting flanges 50 in the illustrated embodiment. The flanges 50 depend downwardly from the planar body portion 46 on opposed sides 58 at the peripheral edge 60. As shown in FIGS. 2 and 3, these flanges locate and engage upon the respective outside surfaces of the rails 32. Flanges generally define an underside channel therebetween which receives the rails therebetween. As a result, the scroll compressor assembly and/or the mounting plate 40 may be slid linearly on the rails to the appropriate mounting location during installation.

In accordance with the present invention, the mounting plate 40 also includes at least one and preferably two support ribs 52. The support ribs 52 project generally along two opposed sides and generally transversely between the mounting flanges and generally between two different corner regions located at intersections between two adjacent sides. The support ribs 52 increase the structural strength and integrity of the mounting plate to prevent the mounting plate from buckling under the weight and operating vibrations that may be caused by the scroll compressor. Specifically, the support ribs 52 interrupt the otherwise thin configuration of the planar body region 46 and thereby increase the strength modulus by increasing the vertical thickness in the cross sectional region of the support rib as shown in FIG. 1.

As shown, the support ribs 52 can be formed by a raised ridge that projects in spaced relation to the outer peripheral edge 60 toward a projecting tip 66. An advantage that may be accomplished with this configuration is two vertically extending thickness regions, each which provides strength enhancement, namely two straight or sloped sides 68 that can extend from the tip 66 to the body region 46. As shown, this configuration can include a generally U-shaped cross section in which each of the sides 68 provide a significant strength enhancement feature. Preferably, one strengthening rib 52 is provided on each side of the scroll compressor 30 to provide for lateral strength on each side. In practicing this aspect, preferably, the support ribs 52 extend and overlap the mounting rails 32 so that the strengthening feature is carried across the full length between the rails. The support ribs 52 can have a straight segment 70 running the length between opposed rails, with rounded ends 72 capping opposed ends of the straight segment 70. Preferably the support ribs take the form of a ridge projected upwardly so that the rib does not actually engage or rest upon the rails. Instead, typically the flat underside of the body region 46 will rest upon the rails. In addition to the ribs preferably extending in overlapping relation to the rails, the ribs 52 can also project on the outside of pairs of mounting holes 53, 54 such that each support rib projects over a range generally between two of the mounting holes and one of the sides connecting corner regions for different mounting holes.

As shown in FIG. 8, an alternative embodiment of the mounting plate 140 is illustrated in which the central region 110 is not aperture, but instead is solid and provides an integral housing section for the housing of the scroll compressor. This embodiment provides the same mounting base 112 as the first embodiment and still supports the scroll compressor just like the first embodiment but it is illustrated that the mounting plate 140 may additionally comprise the concave receptacle 114 upon which the remainder of the scroll compressor housing can be built (e.g. a central housing shell section could be welded to the outside or inside of the receptacle).

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor assembly, comprising:

a scroll compressor;

a mounting base for supporting the scroll compressor, the mounting base having at least two tracks, the tracks configured to mount on two substantilly mounting rails an outer peripheral edge and at least one support rib, the at least one support rib projecting in spaced relation to the outer peripheral edge, wherein the at least one support rib is configured to provide lateral strength to the mounting base, and wherein the at least one support rib partially overlaps the two mounting rails, but does not extend the entire length of the outer peripheral edge.

2. The scroll compressor assembly of claim 1, wherein the at least one support rib extends transversely between the at least two tracks.

3. The scroll compressor assembly of claim 2, further comprises at least two support ribs, including a support rib on opposing sides of the scroll compressor, each support rib extending transversely between the at least two tracks.

4. The scroll compressor of claim 3, wherein the mounting base comprises a formed metal plate having four sides surrounding an annular nest region wherein the scroll compressor is arranged, and four corner regions, each one of the four corner regions located at an intersection between two adjacent sides, each one of the four corner regions having a mounting hole, and wherein the at least two support ribs project on the outside of pairs of the mounting holes such that each one of the at least two support ribs projects in a region between two of the mounting holes and one of the sides connecting the respective one of the four corner regions for said two mounting holes.

5. The scroll compressor of claim 4, wherein the respective ends of each one of the at least two support ribs terminates prior to reaching the respective mounting holes as the at least two support ribs extend transversely.

6. The scroll compressor of claim 5, wherein each one of the at least two tracks comprises a flange depending downwardly from a body of the metal plate at the outer peripheral edge.

7. The scroll compressor of claim 6, further comprising a through-hole provided in each corner region.

8. The scroll compressor of claim 4, wherein each one of the at least two tracks is located on a respective one of the two mounting rails, and wherein opposed ends of the at least two support ribs overlaps only a portion of each of the two mounting rails, respectively, when each track is located on a respective one of the two mounting rails.

9. The scroll compressor of claim 2, wherein the mounting base comprises a formed metal plate, the at least one support rib comprises a raised ridge formed into a body of the base, including a linear segment extending between two rounded ends, the linear segment having a U-shaped cross section.

10. The scroll compressor assembly of claim 1, wherein the scroll compressor comprises a housing containing two scroll compressor bodies and a drive unit operative to facilitate relative movement between the scroll compressor bodies, the scroll compressor bodies having respective bases and respective scroll ribs that project from the respective bases and which mutually engage for compressing fluid, wherein the mounting base is secured to the housing.

11. The scroll compressor assembly of claim 1, wherein the scroll compressor comprises a housing containing two scroll compressor bodies and a drive unit operative to facilitate relative movement between the scroll compressor bodies, the scroll compressor bodies having respective bases and respective scroll ribs that project from the respective bases and which mutually engage for compressing fluid, wherein the mounting base is unitarily formed with a shell member of the housing.

12. A mounting plate for a scroll compressor, comprising a unitary formed metal component part having a body portion with four sides, a central region of the mounting plate forming a nest for support of the scroll compressor, a pair of tracks in the form of flanges depending downwardly from the opposing sides of the body portion, the pair of tracks configured to mount onto a pair of parallel mounting rails, and a pair of support ribs, configured to increase the structural strength of the mounting plate, the pair of support ribs formed into the body portion extending transversely between the flanges, the pair of support ribs having a U-shaped cross section, and wherein each of the pair of support ribs only partially overlaps the pair of mounting rails, when the mounting plate is located on the pair of parallel mounting rails.

13. The mounting plate of claim 12, wherein each one of the pair of support ribs comprises a raised ridge formed into the body portion.

14. The mounting plate of claim 13, wherein the mounting plate has four corner regions, each one of the four corner regions located at an intersection between two adjacent sides, each one of the four corner regions having a mounting hole, and wherein the pair of support ribs project on the outside of pairs of the mounting holes such that each one of the pair of support ribs projects in a region between two of the mounting holes and one of the sides connecting a respective one of the four corner regions for said two mounting holes.

15. The mounting plate of claim 14, wherein the respective ends of each one of the pair of support ribs terminates prior to reaching the respective mounting holes as the pair of support ribs extend transversely.

16. The mounting plate of claim 15, wherein each flange locates along an outside edge of one of the pair of parallel mounting rails, and wherein opposed ends of each one of the pair of support ribs partially overlap the two mounting rails such that the length of each one of the pair of support ribs is approximately equal to the diameter of the mounting hole.

17. The mounting plate of claim 13, wherein each one of the pair of support ribs includes a linear segment extending between opposed rounded ends.

18. The mounting plate of claim 12, wherein the body portion is planar; and a planar region of the body portion surrounds each one of the pair of support ribs.

19. The mounting plate of claim 12, wherein the nest comprises a ring wall depending upwardly from the body portion.

20. The mounting plate of claim 12, wherein the nest comprises a concave receptacle.

* * * * *

UNITED STATES PATENT AND TRADEMARK OFFICE

CERTIFICATE OF CORRECTION

PATENT NO. : 8,142,175 B2
APPLICATION NO. : 12/015643
DATED : March 27, 2012
INVENTOR(S) : Ronald J. Duppert et al.

It is certified that error appears in the above-identified patent and that said Letters Patent is hereby corrected as shown below:

1. At Column 5, line 45 the word "substantilly" is incorrectly spelled and should read "substantially"; and 2. At Column 5, line 45 the word --parallel-- has been omitted and should be inserted after the word "substantially".

Signed and Sealed this
Fifteenth Day of May, 2012

David J. Kappos

David J. Kappos
*Director of the United States Patent and Trademark Office*